US006680586B1

(12) United States Patent
Chen

(10) Patent No.: US 6,680,586 B1
(45) Date of Patent: Jan. 20, 2004

(54) LIGHTING CONSOLE FOR WIRELESSLY CONTROLLING PROFESSIONAL LIGHTING MODULES

(75) Inventor: Heng-Chien Chen, Taipei (TW)

(73) Assignee: Transpace Tech Co., LTD, Wilmington, DE (US)

( * ) Notice: Subject to any disclaimer, the term of this patent is extended or adjusted under 35 U.S.C. 154(b) by 0 days.

(21) Appl. No.: 10/065,656

(22) Filed: Nov. 7, 2002

(51) Int. Cl.[7] ..... G08B 5/00; G05F 1/00

(52) U.S. Cl. ..... 315/291; 340/332; 315/294

(58) Field of Search ..... 315/291, 294, 315/292, 312, 318, 315, 316, 317; 340/332, 691, 628, 815.4

(56) References Cited

U.S. PATENT DOCUMENTS 5,031,082 A * 7/1991 Bierend ..... 362/233
5,392,025 A * 2/1995 Figh et al. ..... 340/547
5,815,068 A * 9/1998 Vadseth ..... 340/332
6,252,358 B1 * 6/2001 Xydis et al. ..... 315/295
6,300,727 B1 * 10/2001 Bryde et al. ..... 315/294
6,424,096 B1 * 7/2002 Lowe et al. ..... 315/185 R
6,459,217 B1 * 10/2002 Belliveau ..... 315/315
6,548,967 B1 * 4/2003 Dowling et al. ..... 315/318

* cited by examiner

*Primary Examiner*—Don Wong
*Assistant Examiner*—Chuc D Tran
(74) *Attorney, Agent, or Firm*—Winston Hsu

(57) ABSTRACT

A professional lighting control system includes a plurality of light modules. Each light module contains a light set with at least one light source and at least one switch for switching the light source on and off. The light module also contains a driving circuit electrically connected to the light set, the driving circuit having at least one switch driver for driving the switch of the light set, and a first transceiver for wirelessly receiving control signals for the light set. The control system also includes a main console, which has a signal generator for generating the control signals that control the light set, and a controller electrically connected to the signal generator for receiving the control signals. The controller has a second transceiver for wirelessly sending control signals received from the signal generator to the first transceiver of the driving circuit so as to control the light set.

14 Claims, 6 Drawing Sheets

LIGHTING CONSOLE FOR WIRELESSLY CONTROLLING PROFESSIONAL LIGHTING MODULES

BACKGROUND OF THE INVENTION

1. Field of the Invention

The present invention relates to a professional lighting control system, and more specifically, to a lighting console with a transceiver for wirelessly controlling a plurality of professional lighting modules.

2. Description of the Prior Art

Lighting control consoles are commonly used in order to control a plurality of lighting modules through a single control console. Please refer to FIG. 1. FIG. 1 is a block diagram of a professional lighting control system 10 according to the prior art. The professional lighting control system 10 includes a console 12 connected to a plurality of lighting sets 18 and 24.

The console 12 comprises a plurality of light control circuits 14 and 20 for generating control signals to control the lighting sets 18 and 24. The light control circuit 14 produces digital control signals and the light control circuits 20 produce analog control signals. A digital bus 19 connects the light control circuit 14 to a driving circuit 16. The driving circuit 16 receives digital control signals from the light control circuit 14 over the digital bus 19, and uses the digital control signals to drive operation of the lighting set 18.

Since the light control circuits 20 produce analog control signals, driving circuits 22 corresponding to each of the light control circuits 20 are often located within the console 12. The driver circuits 22 receive analog control signals from the light control circuits 20, and then drive operation of the lighting sets 24 through power analog buses 26.

The digital bus line 19 is used because some lighting sets like the lighting set 18 require digital control signals for operation of devices such as step motors. The digital bus line 19 can be a multi-channel and a multi-line bus line, and normally is a power digital line of a stepping motor. On the other hand, the power analog buses 26 are used because some lighting sets like the lighting sets 24 require analog control signals for operation of devices such as DC motors or magnetic switches. The power analog buses 26 can be a multi-channel, multi-line, and multi-amplification bus line.

Please refer to FIG. 2. FIG. 2 is a block diagram of the prior art driver circuit 22 and lighting set 24. The driver circuit 22 has a plurality of control interface circuits 30. Each of the control interface circuits 30 is connected to either a switch driver circuit 32 or to a motor driver circuit 34. The lighting set 24 contains a plurality of light sources 40 that are controlled by switches 42 and motors 44. Specifically, each switch driver circuit 32 in the driver circuit 22 corresponds to one of the switches 42 in the lighting set 24. The control interface circuit 30 receives control signals from the light control circuit 20, and passes these commands on to the switch driver circuit 32. The switch driver circuit 32 then sends these commands to the switch 42 for controlling operation of the light source 40. Similarly, each motor driver circuit 34 in the driver circuit 22 corresponds to one of the motors 44 in the lighting set 24. The control interface circuit 30 receives control signals from the light control circuit 20, and passes these commands on to the motor driver circuit 34. The motor driver circuit 34 then sends these commands to the motor 44 for controlling operation of the light source 40.

Unfortunately, the prior art console 12 and lighting sets 18 and 24 are connected together with wired connections. Thus, expensive cable must be run between each lighting set 18 and 24 and the console 12. In addition, if the console 12 is to be moved, care must be taken to ensure that the cables connecting the lighting sets 18 and 24 to the console 12 are long enough to reach the new location of the console 12.

SUMMARY OF INVENTION

It is therefore a primary objective of the claimed invention to provide a professional lighting control system for using a console to wirelessly control a plurality of lighting sets in order to solve the above-mentioned problems.

According to the claimed invention, a professional lighting control system includes a plurality of light modules. Each light module contains a light set with at least one light source and at least one switch for switching the light source on and off. The light module also contains a driving circuit electrically connected to the light set, the driving circuit having at least one switch driver for driving the switch of the light set, and a first transceiver for wirelessly receiving control signals for the light set. The control system also includes a main console, which has a signal generator for generating the control signals that control the light set, and a controller electrically connected to the signal generator for receiving the control signals. The controller has a second transceiver for wirelessly sending control signals received from the signal generator to the first transceiver of the driving circuit so as to control the light set.

It is an advantage of the claimed invention that the console is able to wirelessly control the lighting sets, eliminating the need for expensive cables used to connect the console to the lighting sets. In addition, the console can easily be moved without concern for the wires having sufficient length.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
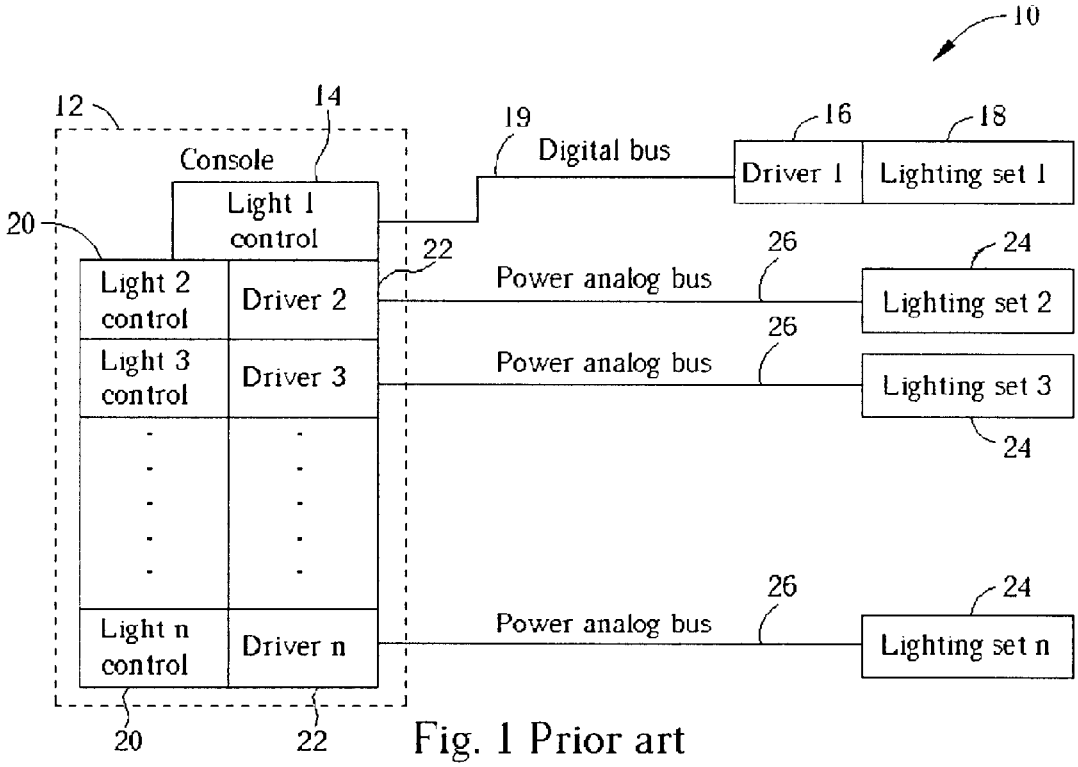
Fig. 1 Prior art
FIG. 1 is a block diagram of a professional lighting control system according to the prior art.
Figure 2:
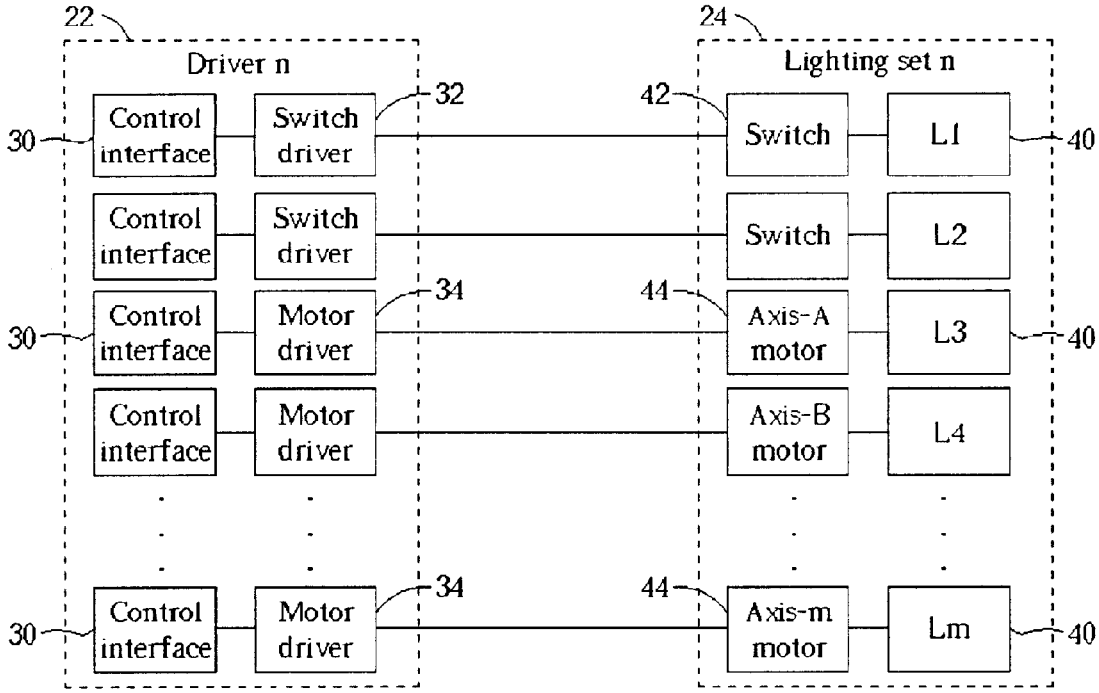
Fig. 2 Prior art
FIG. 2 is a block diagram of a prior art driver circuit and lighting set.
Figure 3:
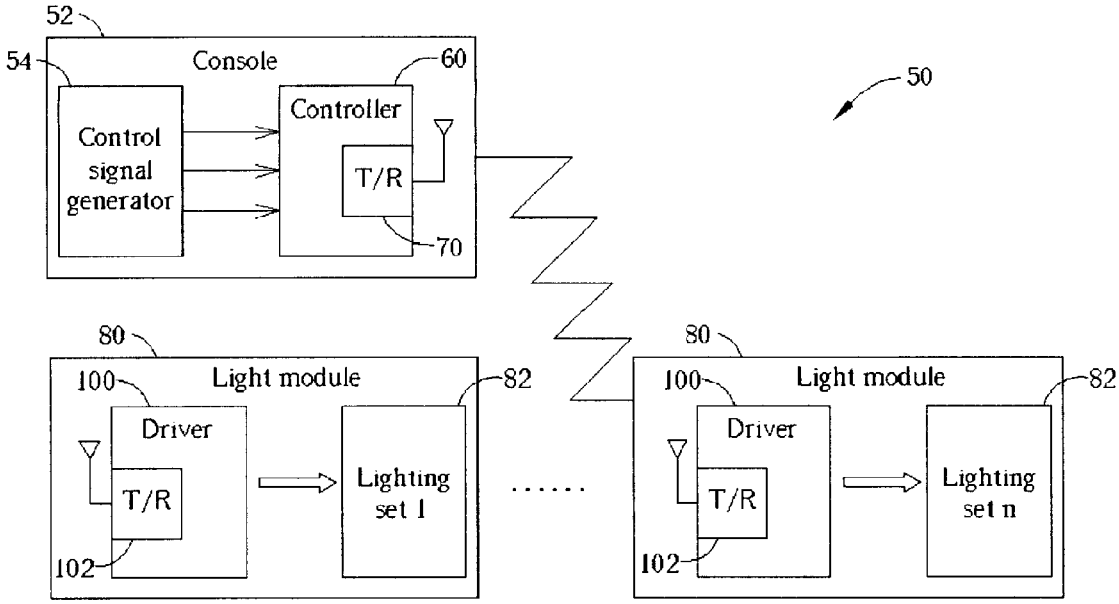
FIG. 3 is a block diagram of a wireless professional lighting control system according to the present invention.

Please refer to FIG. 3. FIG. 3 is a block diagram of a wireless professional lighting control system 50 according to the present invention. The wireless professional lighting control system 50 includes a console 52 and a plurality of light modules 80. The console 52 contains a control signal generator 54, which is used to generate lighting control signals for the light modules 80. The console 52 also contains a controller 60 for wirelessly sending control signals received from the control signal generator 54 to the light modules 80 through a transceiver 70. Each of the light modules 80 contains a driver circuit 100 for receiving the wireless control signals through a transceiver 102, and for using the control signals to drive operation of a lighting set 82. Because the controller 60 contains the transceiver 70 and the driver circuit 100 also contains the transceiver 102, the console 52 is able to wirelessly control each of the light modules 80.

Figure 4:
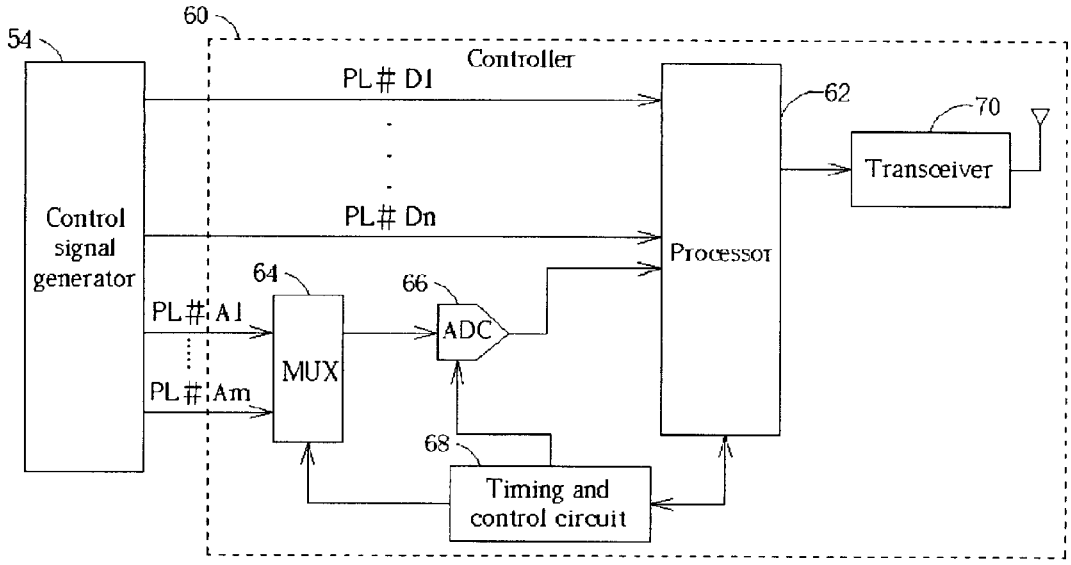
FIG. 4 is a detailed block diagram of a present invention controller.

Please refer to FIG. 4. FIG. 4 is a detailed block diagram of the present invention controller 60. The controller can receive both digital control signals and analog control signals from the control signal generator 54. In FIG. 4, digital professional lighting control signals are labeled PL#D1 to PL#Dn, and analog professional lighting control signals are labeled PL#A1 to PL#Am. The digital control signals are fed into a processor 62 so that the signals can be appropriately packaged and compressed for wireless transmission. A timing and control circuit 68 helps to control timing and operation of the processor. Finally, the processor 62 sends the digital signals to the transceiver 70 for wireless transmission to the light modules 80. During the packaging operation, a unique identifier is put into the packaged signals to denote which light module's 80 control signals are being transmitted.

On the other hand, the analog control signals are all fed into a multiplexer 64. To minimize the complexity of the controller 60, the multiplexer 64 is used to select one analog control signal at a time for processing and transmission. The timing and control circuit 68 is used to select one of the inputted analog signals to be outputted from the multiplexer 64. Signals from the selected analog control signal are then converted into digital signals via an analog-to-digital converter (ADC) 66. Operation of the ADC 66 is also controlled by the timing and control circuit 68. Digital control signals are then sent from the ADC 66 to the processor 62 so that the signals can be appropriately packaged and compressed for wireless transmission. Finally, the processor 62 sends the digital signals to the transceiver 70 for wireless transmission to the light modules 80. Just like before, during the packaging operation, a unique identifier is put into the packaged signals to denote which light module's 80 control signals are being transmitted.

In order to broadcast control signals to all light modules 80, the timing and control circuit 68 will take turns selecting different analog and digital control signals to be sent to the processor 62. Moreover, the switching and transmission of each different control signal is done quickly so that all control signals can be broadcast to all light modules 80 in real time. In this way, all control signals can be wirelessly transmitted to all light modules 80 in the wireless professional lighting control system 50.

Figure 5:
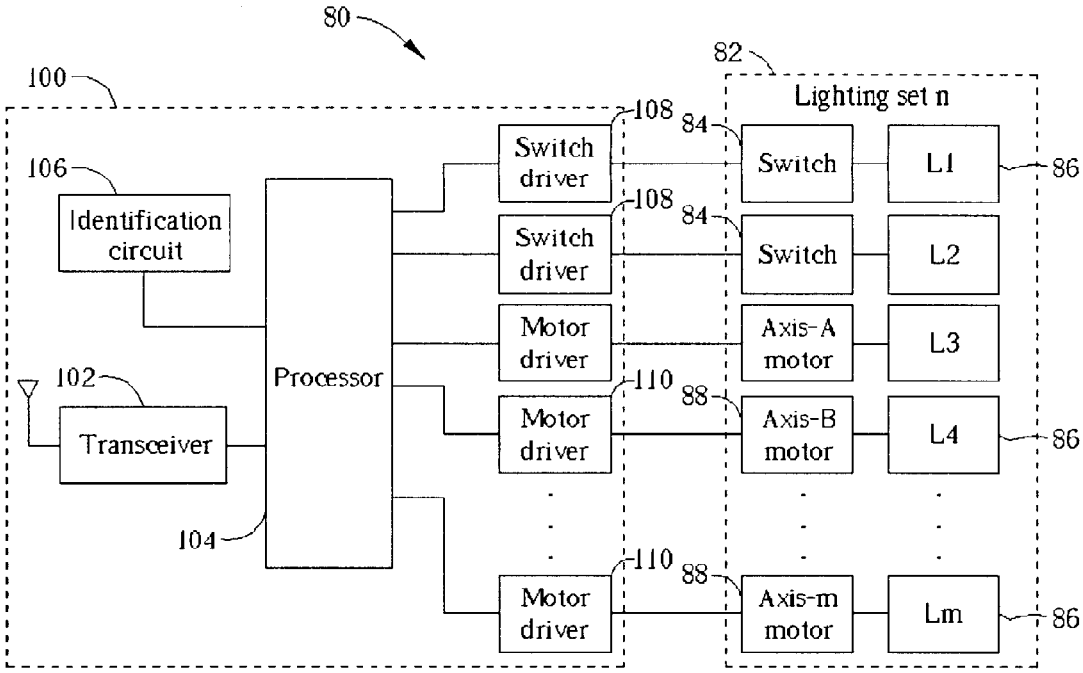
FIG. 5 is a detailed block diagram of a present invention light module in which a lighting set is controlled by digital control signals.

Please refer to FIG. 5. FIG. 5 is a detailed block diagram of the present invention light module 80 in which the lighting set 82 is controlled by digital control signals. The transceiver 102 is used to receive all wireless control signals transmitted by the transceiver 70 of controller 60, and these signals are then sent to a processor 104 for appropriate processing. The processor 104 will then compare the identifier included in the received signals with an identifier stored in an identification circuit 106. If the identifier does not match, the driver circuit 100 does no further processing on the received signals. If there is a match, the received control signals are then sent to an appropriate switch driver circuit 108 or motor driver circuit 110, as determined from the identifier in the control signal. The switch driver circuits 108 and the motor driver circuits 110 respectively drive switches 84 and motors 88 in the lighting set 82. Each of the switches 84 and motors 88 in turn control operation of a light source 86. In this way, control signals received by the transceiver 102 of the driver circuit 100 are able to control each of the light sources 86 in the lighting set 82.

Figure 6:
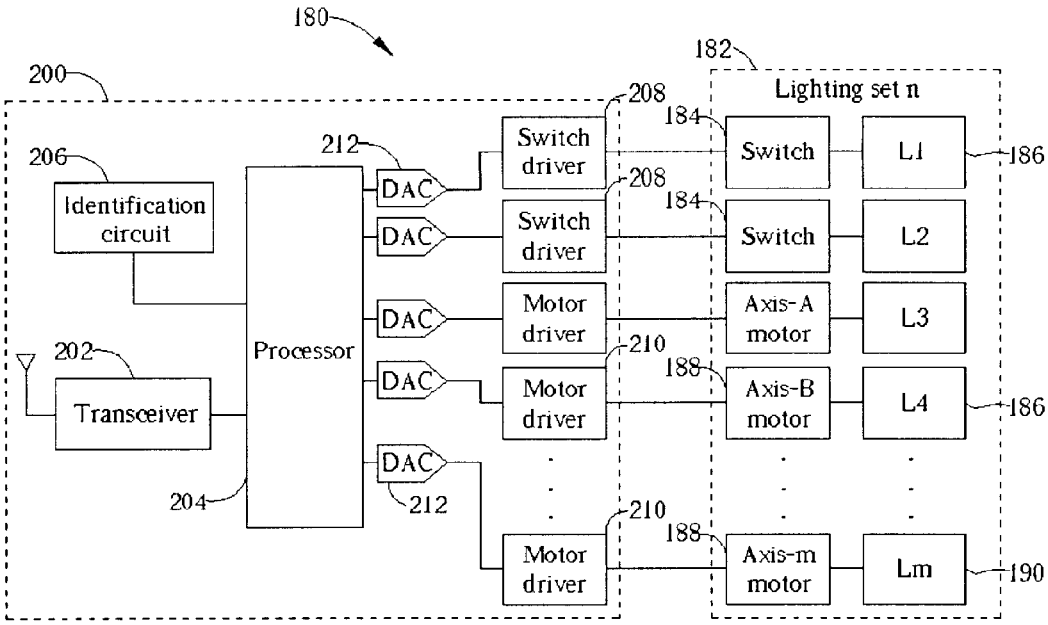
FIG. 6 is a detailed block diagram of a present invention light module in which a lighting set is controlled by analog control signals.

Please refer to FIG. 6. FIG. 6 is a detailed block diagram of a present invention light module 180 in which a lighting set 182 is controlled by analog control signals. The light module 180 is needed in cases where analog devices are used, and is used instead of the light module 80, which controls digital devices. A driver circuit 200 contains a transceiver 202 for receiving all wireless control signals transmitted by the transceiver 70 of controller 60, and these signals are then sent to a processor 204 for appropriate processing. The processor 204 will then compare the identifier included in the received signals with an identifier stored in an identification circuit 206. If the identifier does not match, the driver circuit 200 does no further processing on the received signals. If there is a match, the received control signals are then sent to a digital to analog converter (DAC) 212 for conversion into analog signals, and then to an appropriate switch driver circuit 208 or motor driver circuit 210, as determined from the identifier in the control signal. The switch driver circuits 208 and the motor driver circuits 210 respectively drive switches 184 and motors 188 in the lighting set 182. Each of the switches 184 and motors 188 in turn control operation of a light source 186. In this way, control signals received by the transceiver 202 of the driver circuit 200 are able to control each of the light sources 186 in the lighting set 182.

In a preferred embodiment of the present invention, all wireless signals used in communication between the transceiver of controller and the transceivers of the light modules are direct sequence spread spectrum (DSSS) signals that conform to the IEEE 802.11b networking standard.

Compared to the prior art, the wireless professional lighting control system is able to send control signals from the console to lighting sets via wireless transmission, eliminating the need for expensive cables used to connect the console to the lighting sets. In addition, the console can easily be moved without concern for the wires having sufficient length.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A professional lighting control system comprising:

a plurality of light modules, each comprising:

a light set comprising at least one light source and at least one switch for switching the light source on and off; and a driving circuit electrically connected to the light set, the driving circuit comprising at least one switch driver for driving the switch of the light set, and a first transceiver for wirelessly receiving control signals for the light set; and a main console comprising:

a signal generator for generating the control signals that control the light set; and a controller electrically connected to the signal generator for receiving control signals that control the light set, the controller comprising:

a second transceiver for wirelessly sending control signals received from the signal generator to the first transceiver of the driving circuit so as to control the light set; and a multiplexer having a plurality of input nodes and one output node, each input node being used to receive control signals from the signal generator, the output node being used for outputting control signals corresponding to a selected light module.

2. The control system of claim 1 wherein the light set further comprises at least one step motor for changing an orientation direction of the light source of the light set, and the driving circuit further comprises at least one step motor driver for driving the step motor of the light set.

3. The control system of claim 1 wherein the control signals generated by the signal generator are analog control signals, and an analog to digital converter is connected to the output of the multiplexer for converting the analog control signals into digital control signals.

4. The control system of claim 1 wherein the driving circuit further comprises a first processor for controlling operation of the driving circuit, and the controller further comprises a second processor for controlling operation of the controller.

5. The control system of claim 4 wherein the driving circuit further comprises an identifying circuit for storing identification information that uniquely identifies the corresponding light module, and the first processor of the driving circuit only processes control signals that contain identification information identical to identification information located in the identifying circuit.

6. The control system of claim 1 wherein the wireless signals transmitted between the first transceiver to the second transceiver are direct sequence spread spectrum signals.

7. The control system of claim 1 wherein the wireless signals transmitted between the first transceiver to the second transceiver conform to the IEEE 802.11b networking standard.

8. A professional lighting control system comprising:

a plurality of light modules, each comprising:

a light set comprising:

at least one light source and at least one switch for switching the light source on and off; and at least one step motor for changing an orientation direction of the light source of the light set; and a driving circuit electrically connected to the light set, the driving circuit comprising:

at least one switch driver for driving the switch of the light set;

a first transceiver for wirelessly receiving control signals for the light set; and at least one step motor driver for driving the step motor of the light set; and a main console comprising:

a signal generator for generating the control signals that control the light set; and a controller electrically connected to the signal generator for receiving control signals that control the light set, the controller comprising a second transceiver for wirelessly sending control signals received from the signal generator to the first transceiver of the driving circuit so as to control the light set.

9. The control system of claim 8 wherein the controller further comprises a multiplexer having a plurality of input nodes and one output node, each input node being used to receive control signals from the signal generator, the output node being used for outputting control signals corresponding to a selected light module.

10. The control system of claim 9 wherein the control signals generated by the signal generator are analog control signals, and an analog to digital converter is connected to the output of the multiplexer for converting the analog control signals into digital control signals.

11. The control system of claim 8 wherein the driving circuit further comprises a first processor for controlling operation of the driving circuit, and the controller further comprises a second processor for controlling operation of the controller.

12. The control system of claim 11 wherein the driving circuit further comprises an identifying circuit for storing identification information that uniquely identifies the corresponding light module, and the first processor of the driving circuit only processes control signals that contain identification information identical to identification information located in the identifying circuit.

13. The control system of claim 8 wherein the wireless signals transmitted between the first transceiver to the second transceiver are direct sequence spread spectrum signals.

14. The control system of claim 8 wherein the wireless signals transmitted between the first transceiver to the second transceiver conform to the IEEE 802.11b networking standard.

* * * * *